US009850049B2

(12) United States Patent
Gallup et al.

(10) Patent No.: US 9,850,049 B2
(45) Date of Patent: Dec. 26, 2017

(54) FLEXIBLE WIRE TIE

(71) Applicant: Lagpull Industries, Inc., Rochester Hills, MI (US)

(72) Inventors: Eric Gallup, Rochester Hills, MI (US); Dino Kasvikis, Mansfield, MA (US)

(73) Assignee: LAGPULL INDUSTRIES, INC., Rochester Hills, MI (US)

( * ) Notice: Subject to any disclaimer, the term of this patent is extended or adjusted under 35 U.S.C. 154(b) by 470 days.

(21) Appl. No.: 14/215,753

(22) Filed: Mar. 17, 2014

(65) Prior Publication Data

US 2014/0290011 A1 Oct. 2, 2014

Related U.S. Application Data

(60) Provisional application No. 61/789,833, filed on Mar. 15, 2013.

(51) Int. Cl.
*A44B 99/00* (2010.01)
*B65D 63/02* (2006.01)

(52) U.S. Cl.
CPC ..... *B65D 63/02* (2013.01); *Y10T 24/15* (2015.01)

(58) Field of Classification Search
CPC ..... B65D 63/02; B65D 63/10; Y10T 24/15
USPC ..... 24/16 R, 16 PB, 30.5 T; 248/205.1, 214, 248/302; 294/141, 147, 165
See application file for complete search history.

(56) References Cited

U.S. PATENT DOCUMENTS

| | | | | |
|---|---|---|---|---|
| 2,175,036 | A * | 10/1939 | Sipe | H01R 4/10 174/84 S |
| 5,199,135 | A * | 4/1993 | Gold | B65D 63/18 24/16 R |
| 5,498,190 | A * | 3/1996 | Ganson | A63H 33/04 446/107 |
| 6,206,542 | B1 * | 3/2001 | Case | F21V 21/0925 362/190 |
| 8,256,812 | B2 | 9/2012 | Daniel | |
| 8,322,297 | B2 * | 12/2012 | Petrenko | G09F 17/00 116/173 |
| 8,387,216 | B1 | 3/2013 | Martinson | |
| 2011/0286217 | A1 * | 11/2011 | Martinson | B65D 63/00 362/253 |
| 2013/0026316 | A1 | 1/2013 | Case et al. | |
| 2013/0037672 | A1 * | 2/2013 | Sanchez | B60R 7/10 248/303 |
| 2016/0009470 | A1 | 1/2016 | Martinson | |

* cited by examiner

*Primary Examiner* — Robert J Sandy
*Assistant Examiner* — David Upchurch
(74) *Attorney, Agent, or Firm* — Carlson, Gaskey & Olds, P.C.

(57) ABSTRACT

A twist tie assembly has a flexible wire tie with an end cap component configured to retain the flexible wire tie in the base. Various embodiments of the end cap component provide means for releasably securing the flexible wire tie to a base or support structure.

14 Claims, 10 Drawing Sheets

FLEXIBLE WIRE TIE

CROSS-REFERENCE TO RELATED APPLICATIONS

This application claims the benefit of U.S. Provisional Application No. 61/789,833, filed Mar. 15, 2013.

FIELD

The present disclosure relates to a twist tie device and more particularly to a flexible wire tie having at least one end cap component configured to secure the wire tie in a base or other support structure.

BACKGROUND

This section provides background information related to the present disclosure which is not necessarily prior art.

Twist ties are generally known in the art for enclosing bags and/or bundling objects together. Recent developments in this art provide a coated flexible wire tie or twist tie device as shown in FIG. 11A that is suitable for supporting weight or bundling large objects. Examples various twist tie devices are disclosed in U.S. Pat. No. 8,256,812 entitled Wrap For Bundling Objects and U.S. Pat. No. 8,387,216 Tie Wrap For Bundling Objects which describe flexible wire ties having an elongated piece of shape-retaining deformable core with a rubber or foam cover.

Such twist tie devices have been used in assorted applications some of which are described in US Patent Application Publication No. 2013/0026316 entitled Tie Wrap For Bundling Objects and U.S. Provisional Application No. 61/724,814 entitled Organizing Device With Flexible Ties. In these applications, the twist tie device either terminates with a free end or is covered by a small cap. The only function of the end cap is to terminate the twist tie device which would other leave the core exposed. The bundling, organizing and securing function are carried out by the elongated, bendable, shape-retaining body. The disclosure of U.S. Provisional Application No. 61/724,814 is expressly incorporated by reference herein.

A mountable twist tie product recently introduced by Nite Ize LLC of Boulder, Colo. is shown in FIGS. 11B and 11C. This product has a round molded base backed with 3M® Acrylic Plus Tape™ that may be attached to a variety of surfaces. A twist tie extends from the base and terminates with a simple end cap. The twist tie can be bent to form a hanger for objects such as keys or leashes or to wrap around objects such as cords or sunglasses.

The nature and variety of uses for such twist tie devices could be significantly increased if additional functional features were incorporated into an end cap component. Thus, there remains a need for a flexible wire tie with a functional end cap component that can be used in combination with a base or support structure.

SUMMARY

This section provides a general summary of the disclosure, and is not a comprehensive disclosure of its full scope or all of its features.

In accordance with the present teachings, a twist tie assembly is disclosed that has a functional end cap component including various means for releasably securing the flexible wire tie to a base or support structure.

In one aspect, the twist tie device includes a base having a hole formed therethrough, a flexible wire tie having an elongated body sized to pass through the hole formed in the base, and an end cap component disposed on an end of the elongated body, wherein the end cap component is oversized with respect to the hole to support the flexible wire tie on the base. The end cap may be added to an existing flexible wire tie or integrally formed on an end thereof.

In another aspect, the twist tie device includes a base having a male interlocking element formed on a face thereof and a flexible wire tie having elongated body extending from the base. The male interlocking element is configured to releasably secure with a female interlocking element disposed on a support surface.

In yet another aspect, the twist tie device includes a flexible wire tie having elongated body and an end cap component in the form of a ring disposed on a first end of the elongated body. The ring has an opening sized to allow a second end of the elongated body to pass through the ring to form a running noose. In this way, the flexible wire tie may be lassoed around a support structure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 9A:
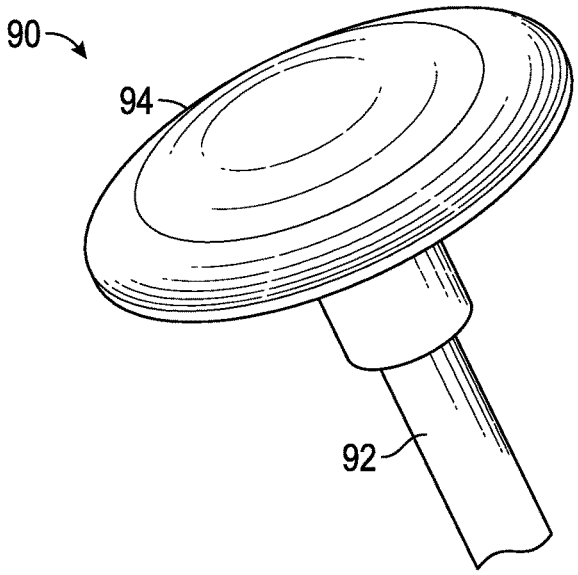
Figure 9B:
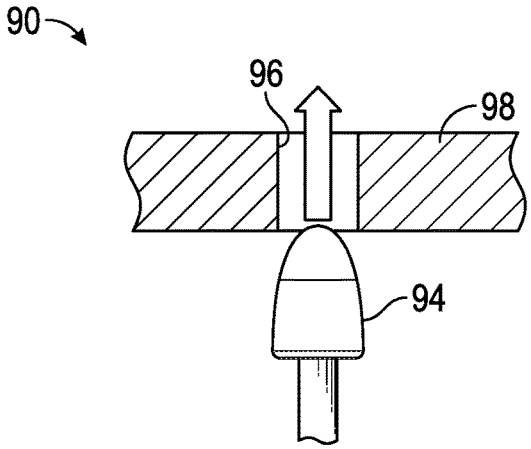
Figure 9C:
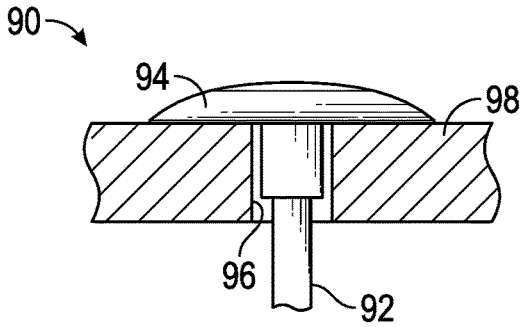
Figure 10:
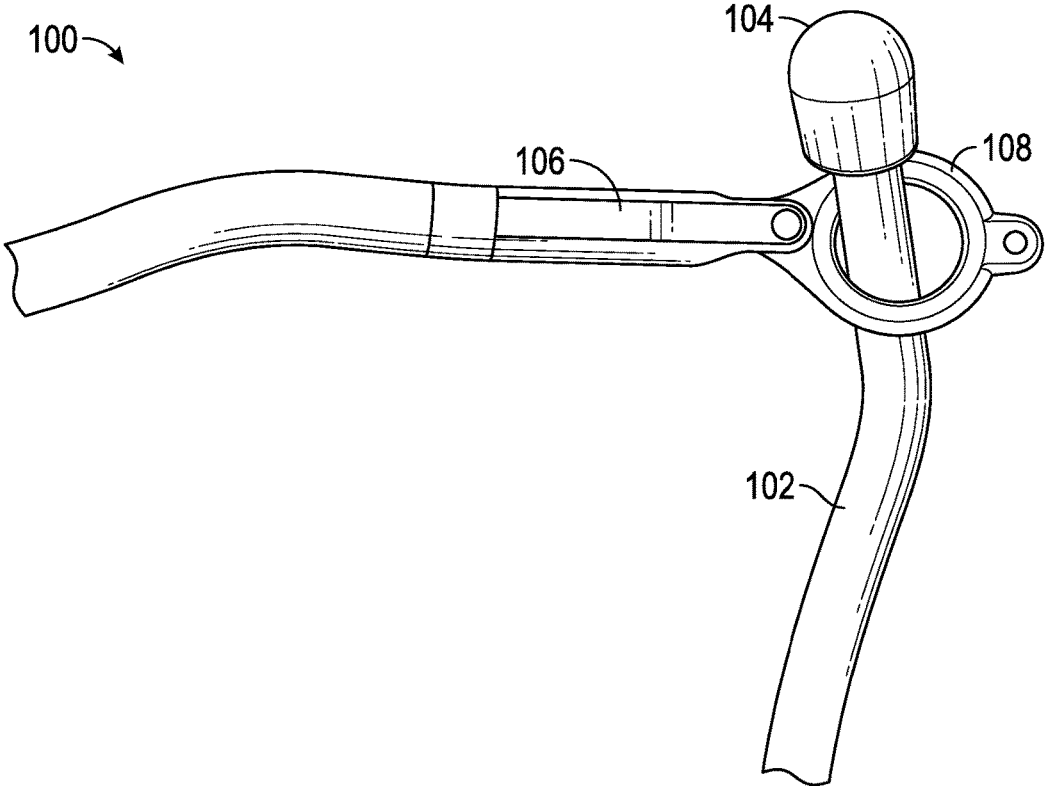
Figure 11A:
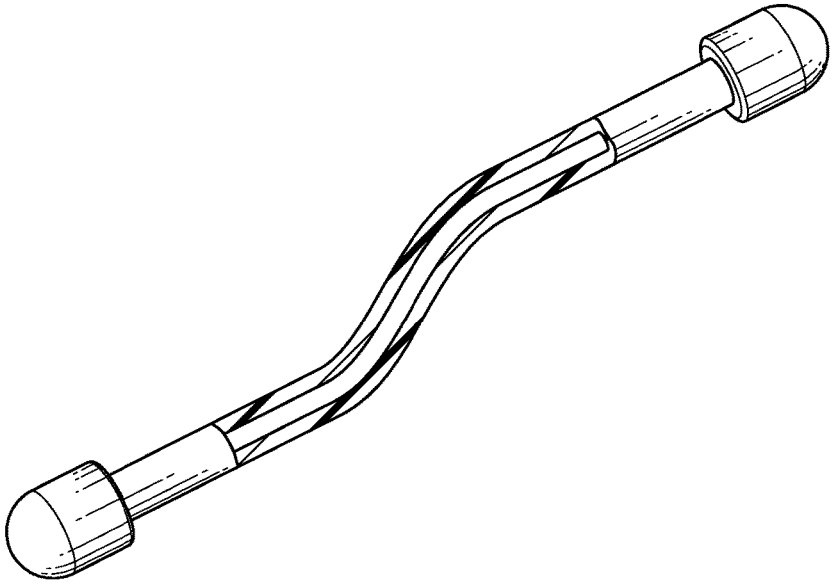
FIG. 11A (Prior Art)
Figure 11B:
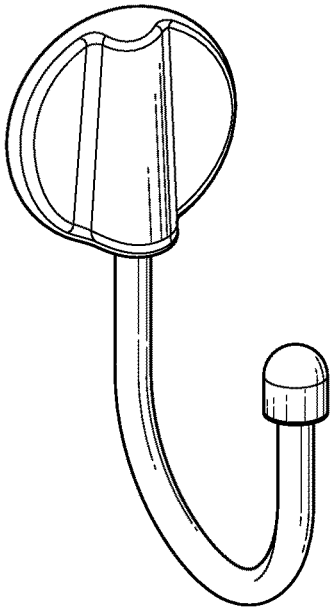
FIG. 11B (Prior Art)
Figure 11C:
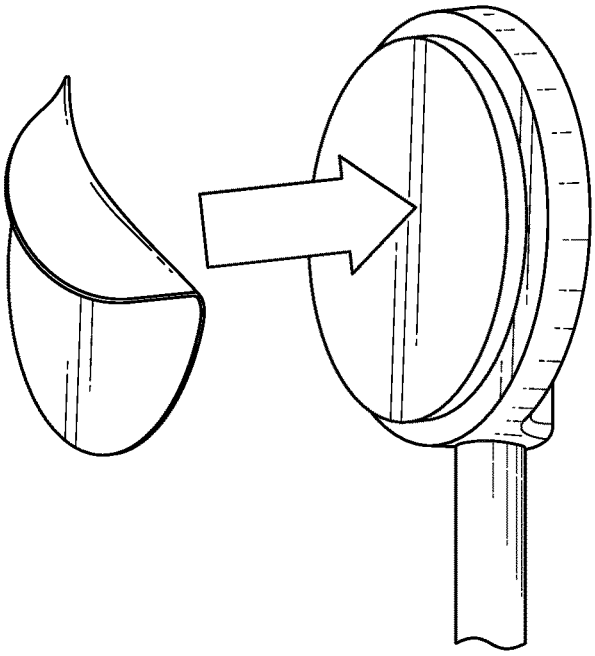
FIG. 11C (Prior Art)

FIG. 9A-9*c* illustrates an embodiment of a twist tie device having a resilient end cap component formed on an end of a flexible wire tie, wherein the end cap component is capable of passing through a hole and configured to support the tie in a base;

FIG. 10 illustrates an embodiment of a twist tie device having a flexible wire tie with a ring at one end to allow the other end to pass through the ring to form a running noose; and FIGS. 11A-11C illustrate a conventional twist tie and the mountable product as described in the background above.

Corresponding reference numerals indicate corresponding parts throughout the several views of the drawings.

DETAILED DESCRIPTION

Example embodiments will now be described more fully with reference to the accompanying drawings.

Figure 1A:
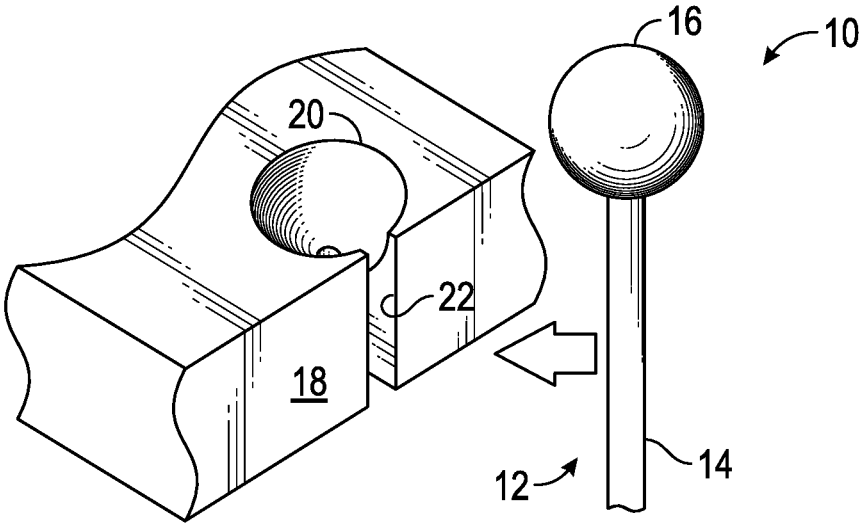
FIGS. 1A-1B illustrate an embodiment of a twist tie device having an spherical end cap component integrally formed on an end of a flexible wire tie and configured to support the tie in a base.
Figure 1B:
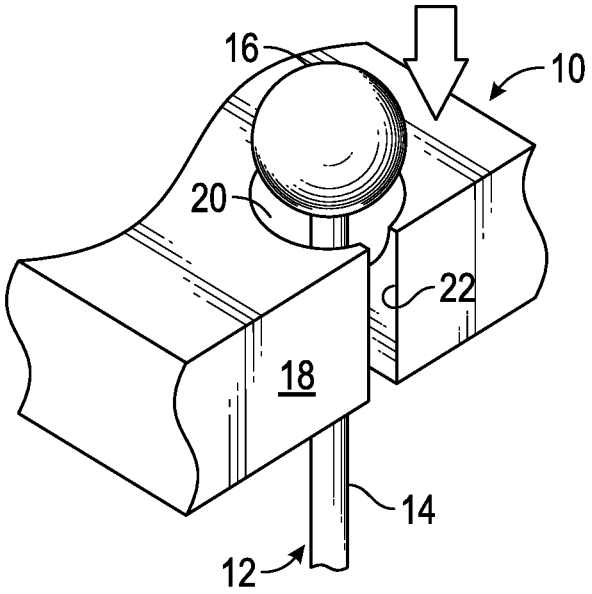

With reference now to FIGS. 1A-1B, a twist tie device 10 is shown having a flexible wire 12 defining an elongated body 14 with a spherical end cap 16 formed thereon. A base 18 has a hole 20 formed therethrough and a slot 22 extending from an edge into the hole. The spherical end cap 16 is oversized with respect to hole 20 to retain and support the flexible wire tie 12 in the base 18. In particular, elongated body 14 is inserted through slot 22 such that spherical end caps 16 nests in hole 20 and prevents removal of the flexible wire 12 from the base 18. One skilled in the art will readily recognize that the base 18 does not require a slot 22 but may include a hole circumscribed by the base, provided the end of the flexible wire 12 opposite spherical end cap 16 is small enough to pass through hole 20. Spherical end cap 16 is integrally formed on an end of flexible wire 12 by any suitable forming and molding process.

Figure 2A:
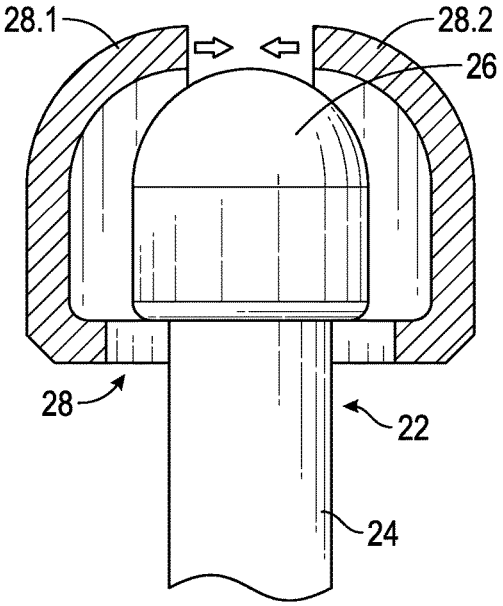
FIGS. 2A-2B illustrate an auxiliary end cap component which covers an existing end cap on a flexible wire tie.
Figure 2B:
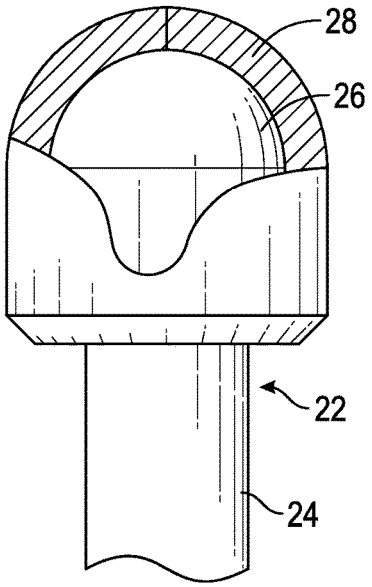
Figure 2C:
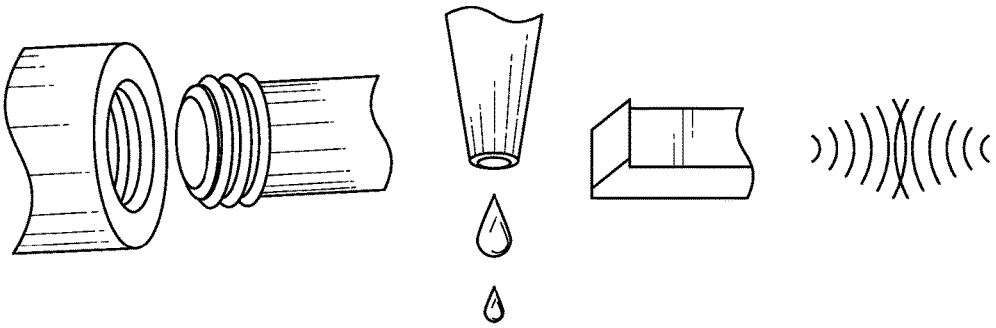
FIG. 2C illustrates various means for securing an end cap component on to a flexible wire tie.

With reference now to FIGS. 2A-2B, an end cap component is shown which may be used to reconfigure an existing gear tie to provide an oversized end cap component. Specifically, a flexible wire tie 22 includes an elongated body 24 having an existing end cap 26 disposed thereon. An auxiliary end cap component 28 includes a pair of cap halves 28.1, 28.2 which may be secured over the existing end cap 26 to provide an enlarged end cap component. As seen in FIG. 2C, the auxiliary cap component 28 may be secured to the end of the flexible wire tie 22 by any suitable means including press fit, glue, snap fit or ultrasonic welding.

Figure 3A:
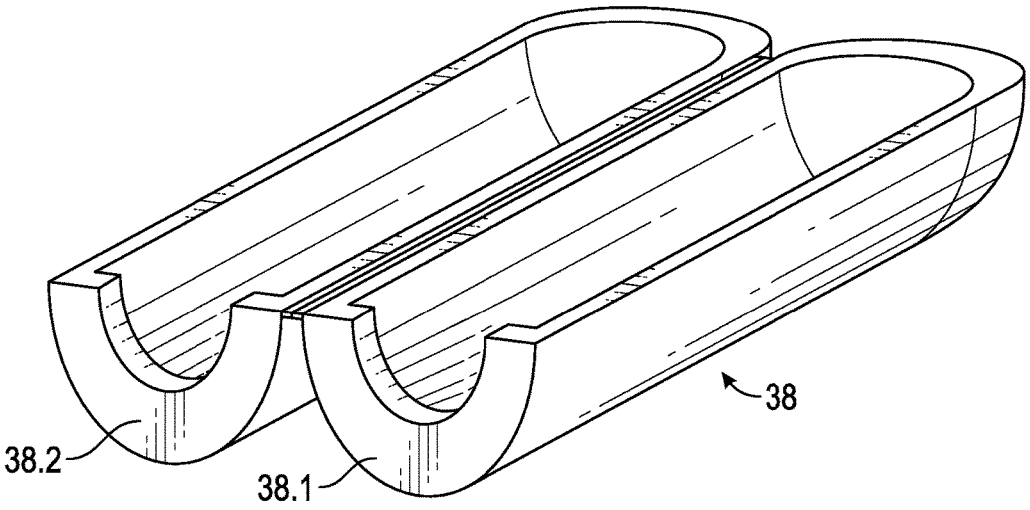
FIGS. 3A-3B illustrate an end cap component similar to that shown in FIGS. 2A-2B.
Figure 3B:
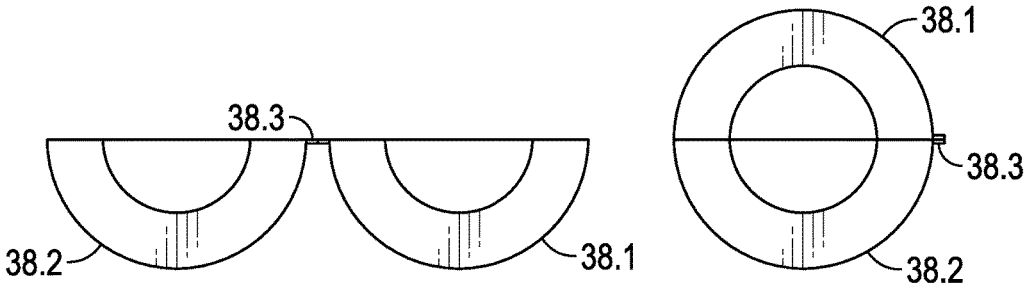

With reference now to FIGS. 3A-3B, an auxiliary end cap component 38 is shown. Similar to auxiliary end cap component 28, auxiliary end cap component 38 includes a pair of cup shaped elements 38.1, 38.2 having a living hinge 38.3 formed therebetween. In this manner, auxiliary end cap component 38 may be a snap fit over an end of a flexible wire tie to provide an oversized end cap component.

Figure 4A:
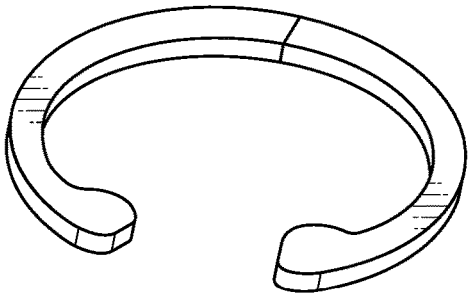
FIGS. 4A-4D illustrate an end cap component which cooperates with an existing end cap on a flexible wire tie so that the tie may be supported in a base.
Figure 4B:
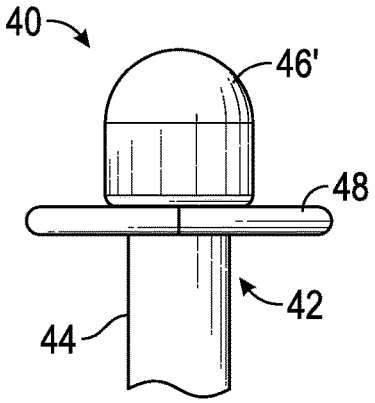

With reference now to FIGS. 4A-4B, a twist tie device 40 is illustrated having a flexible wire tie 42 with an elongated body 44. The existing end cap 46 is secured to an end of the flexible wire tie 42. An auxiliary end cap component 48 in the form of a C/E clip is located on the medial side of end cap 46 to provide an oversized or enlarged end cap component. The C/E configuration of the auxiliary end cap component 48 allows the elongated body to pass through the opening while the clip abuts the bottom of end cap 46.

Figure 4C:
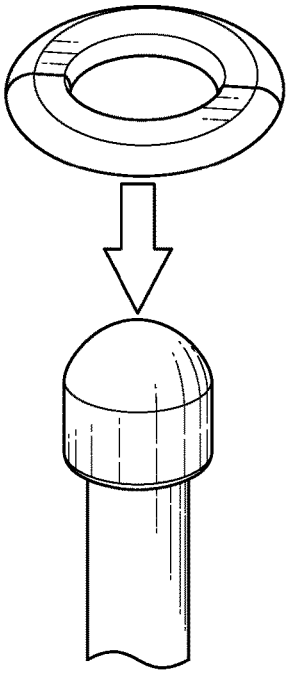
Figure 4D:
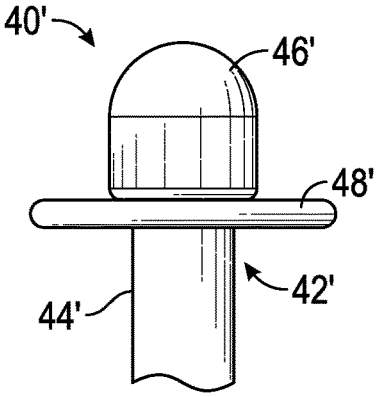

With reference now to FIGS. 4C-4D, a similar configuration is provided in which the twist tie device 40' includes a flexible wire tie 42' having an elongated body 44' and an existing end cap 46' secured to the end of the elongated body 44'. An auxiliary end cap component 48' in the form of a flexible ring is located on a medial side of the end cap 46' to provide an oversized or enlarged end cap component. The flexible ring component may be constructed of a resilient material such that it may be stretched over the end cap 46' and retained on the elongated body 44'. Alternately, the flexible ring 48' may be a two-part component which snaps together about the elongated body 44'.

Figure 5:
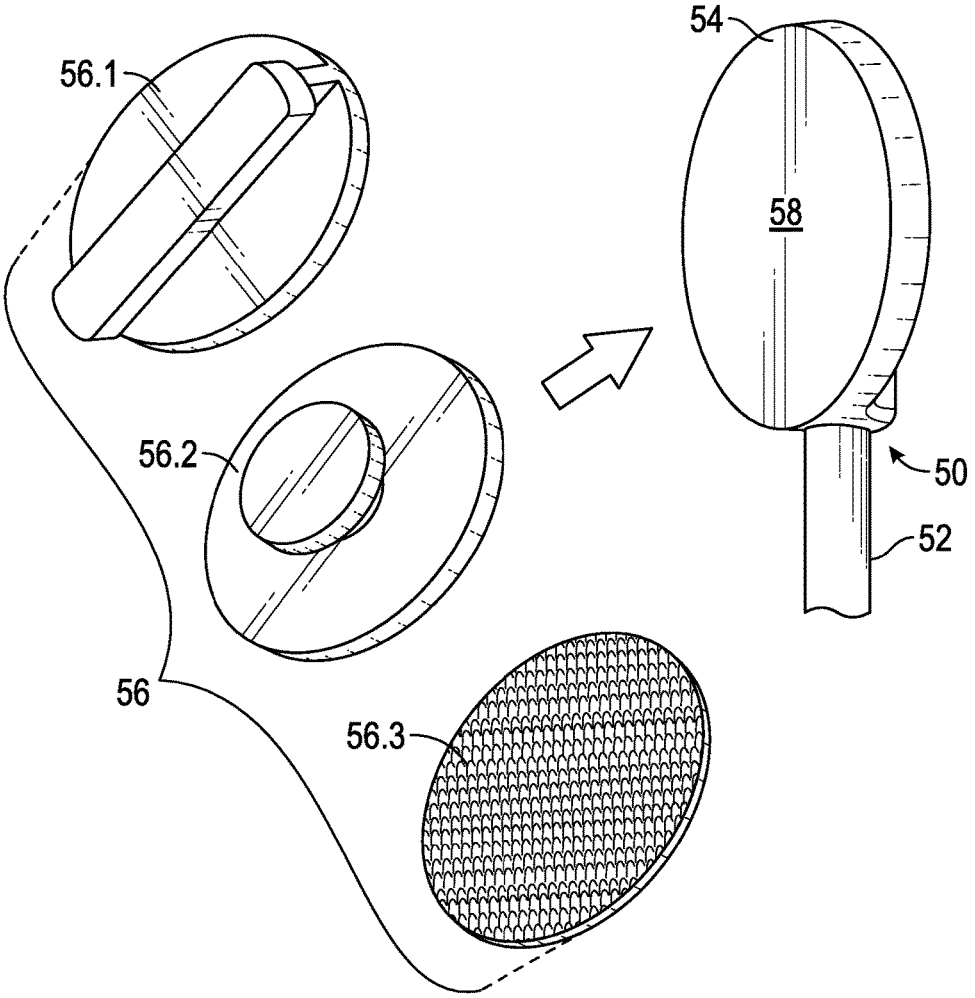
FIG. 5 illustrates an embodiment of a twist tie device having a base with a flexible wire tie and a male interlocking element which is configured to releasably secure with a female interlocking element disposed on a support surface.

With reference now to FIG. 5, a twist tie device 50 is illustrated having a flexible wire tie 52 extending from base 54. A male interlocking element 56 extends from a face of the base 54 and is configured to releasably secure the twist device 50 with a complimentary female interlocking element disposed on an adjacent support surface (not shown closed). The male interlocking 56 may take one of several forms including a T-shape extension 56.1 projecting from the face 58 of base 54 which would engage a complementary T-shape slot formed in an adjacent support surface. Alternately, the male interlocking element 56 may take the form of a circular button 56.2 extending from the face 58 of the base 54 which would be received in a T-shaped slot formed in the adjacent supporting structure. In yet another form, the male interlocking element 56 may take the form of a hook type fastener 56.3 used in conventional hook and loop fastening mechanisms such as Velcro®. The male interlocking elements 56 may be formed integral on the base 54 or may be an auxiliary component which is secured to the face 58 of base 54 by an adhesive or other suitable means.

Figure 6:
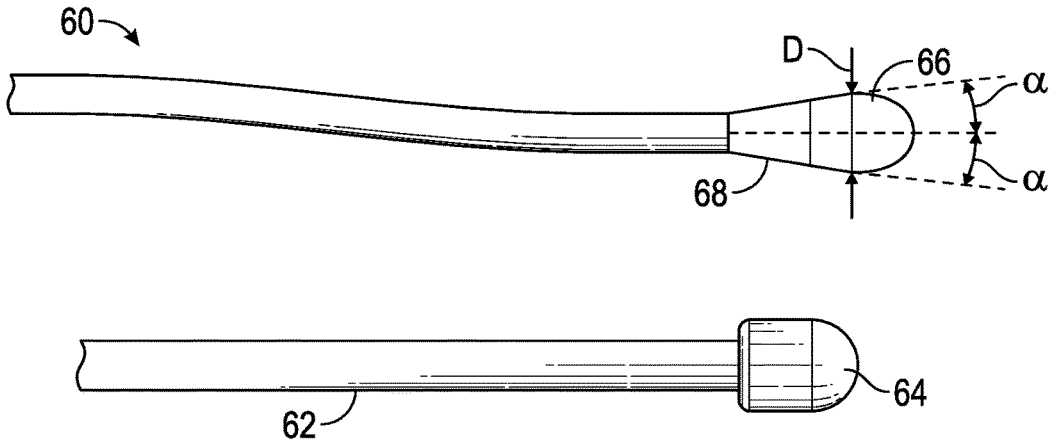
FIG. 6 illustrates an embodiment of a twist tie device similar to that shown in FIGS. 1A-1B with a tapered longitudinal face.

Referring now to FIG. 6, a twist tie device 60 is illustrated having a flexible wire tie 62, a conventional end cap 64 is disposed on one end of the flexible wire tire 62 and an enlarged end cap component 66 formed on the opposite end of the flexible wire tie 62. The auxiliary end cap component 66 has a generally conical or tapered longitudinal face 68 extending from a major diameter D of the end cap component 66 to the elongated body of the flexible wire tire 62. As presently preferred, the tapered longitudinal face 68 forms an angle $\alpha$ of approximately 7-10 degrees. Twist tie device 60 would be used in conjunction with a base or support structure having a tapered bore formed therethrough such that the tapered longitudinal face 68 engages a complimentary surface on the tapered bore to firmly seat the twist tie device in the base (not shown).

Figure 7B:
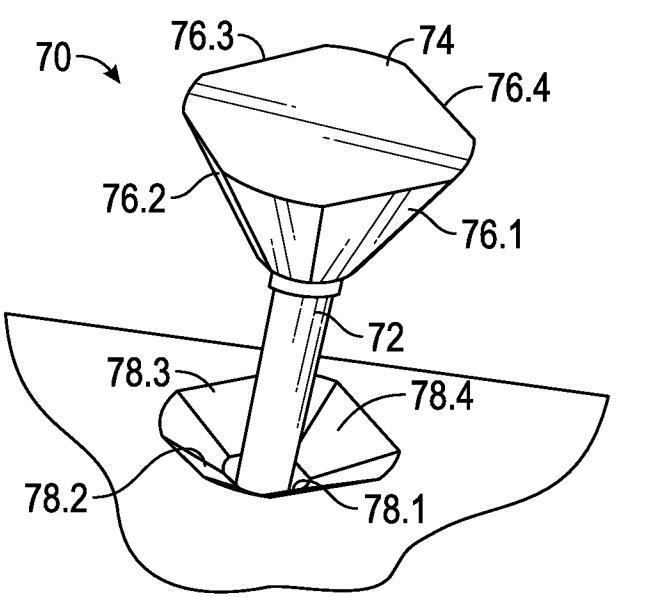
FIGS. 7A-7B illustrate an embodiment of a twist tie device similar to that shown in FIG. 6 with a tapered longitudinal face.
Figure 7B:
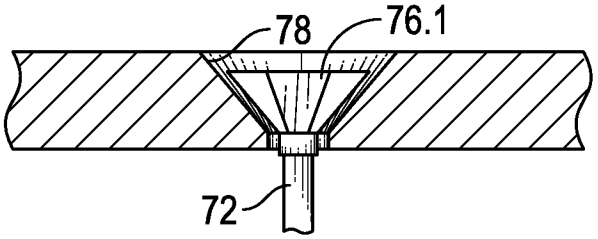
Figure 7A:
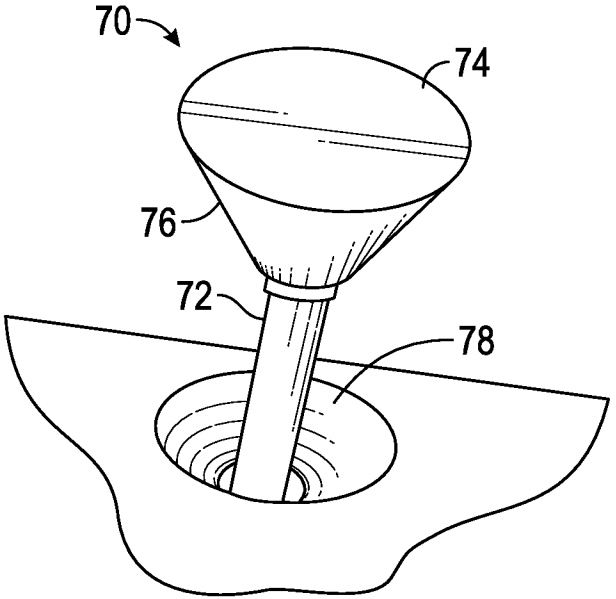
Figure 7A:
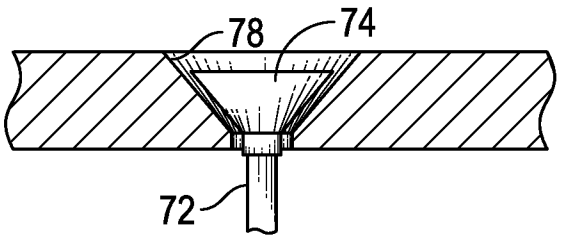

With reference now to FIGS. 7A-7B, a twist tie device 70 is illustrated having a flexible wire tie 72. The auxiliary end cap component 74 includes a tapered face 76 similar to that previously described with reference to FIG. 6. As illustrated in these figures, the tapered face 76 has an angle approaching 45 degrees. As seen in FIG. 7A, the auxiliary end cap component 74 would be suitable for seating within a conventional counter sink hole 78. With reference to FIG. 7B, the tapered face 76 has a series of flat regions (76.1-76.4) which correspond with flats (78.1-78.4) formed in the counter sink hole 78 to prevent rotation of the flexible wire tie.

Figure 8A:
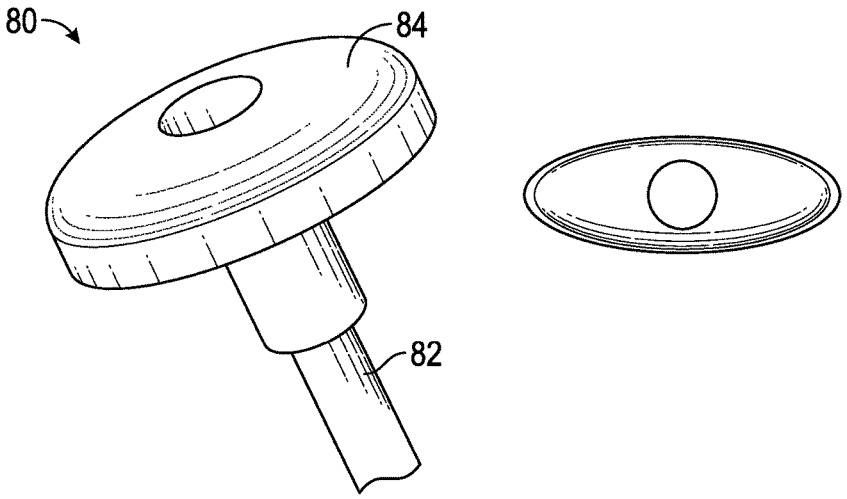
FIG. 8A-8B illustrate an embodiment of a twist tie device having an end cap component formed on an end of a flexible wire tie and configured to support the tie in a base.
Figure 8B:
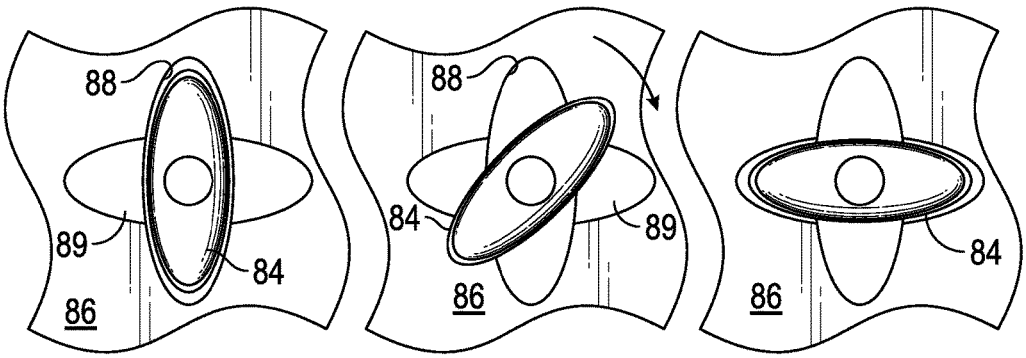

With reference now to FIGS. 8A-8B, a twist tie 80 is illustrated having a flexible wire tie 82 and an elongated end cap component 84. The base 86 has an elongated hole 88 formed therethrough which allows the elongated end cap component 84 to be passed therethrough. Once the elongated end cap 84 is passed through the hole 88, it may be rotated 90 degrees as shown in sequence (FIG. 8B) such that it cannot be withdrawn through the hole 88. An indent 89 may be formed in the top surface of the base to provide a locking position for the elongated end cap component 84.

With reference now to FIGS. 9A-9C, a twist tie device 90 is illustrated having a flexible wire tie 92 and a resilient end cap component 94. In particular, the resilient end cap component 94 has a mushroom configuration and is resilient such that the cap may deform (see FIG. 9B) when it is inserted through a hole 96 in base 98. Once the end cap component 94 extends past the upper surface of base 98 it expands back to its original shape and provides an enlarged end cap component to support the flexible wire tie 92 in the base 98.

With reference now to FIG. 10, a twist tie device 100 is illustrated having a flexible wire tie 102 with a conventional end cap 104 formed on an end thereof. The opposite end of the flexible wire tie 102 has an end cap component 106 in the form of a ring 108 disposed on an end of the flexible wire tie 102. The ring 108 has opening formed therethrough which allows the end cap 104 to pass through the ring 108 to form a running noose. In this way, the twist tie device 100 may be lassoed around a support structure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A twist tie device comprising:

a base having a hole formed therethrough;

a flexible wire tie having elongated body sized to pass through the hole formed in the base, wherein the flexible wire tie includes a shape-retaining deformable metal core with a rubber cover or a foam cover; and an end cap component disposed on an end of the elongated body, wherein the end cap component is oversized with respect to the hole for supporting the flexible wire tie on the base, wherein the end cap component comprises a resilient cap, the resilient cap capable of collapsing to pass through the hole and expanding to support the flexible wire tie on the base.

2. The twist tie device of claim 1 wherein the end cap component is integrally formed on the end of the elongated body.

3. The twist tie device of claim 1 further comprising an end cap secured to the end of the flexible wire tie, and wherein the end cap component is secured over the end cap.

4. The twist tie device of claim 3 wherein the end cap component comprises a clip configured to nest underneath the end cap.

5. The twist tie device of claim 3 wherein the end cap component comprises a flexible ring configured to nest underneath the end cap.

6. The twist tie device of claim 1 wherein the end cap component has a tapered longitudinal face.

7. The twist tie device of claim 6 wherein the base has a tapered bore formed therein such that the tapered longitudinal face engages the tapered bore.

8. The twist tie device of claim 6 wherein the tapered longitudinal face has at least one flat face formed therein for preventing rotation of the flexible wire tie in the hole.

9. The twist tie device of claim 1 wherein the end cap component has an oblong head, and the base has an elliptical hole for receiving the oblong head, wherein, the flexible tie is rotatably positionable in the elliptical hole for locking the flexible wire tie into the base.

10. A twist tie device comprising:

a flexible wire tie having an elongated body; and a ring disposed on a first end of the elongated body, the ring having an opening sized to allow a second end of the elongated body to pass through the ring on the first end of the elongated body, wherein the flexible wire tie is configured to lasso around a support structure by passing the second end of the elongated body through the ring on the first end of the elongated body.

11. The twist tie device of claim 10 wherein the second end of the elongated body has an end cap secured thereto.

12. The twist tie device of claim 10 wherein the flexible wire tie includes a shape-retaining deformable metal core with a rubber cover or a foam cover.

13. A twist tie device comprising:

a base having a hole formed therethrough;

a flexible wire tie having elongated body sized to pass through the hole formed in the base, wherein the flexible wire tie includes a shape-retaining deformable metal core with a rubber cover or a foam cover; and an end cap component disposed on an end of the elongated body, wherein the end cap component is oversized with respect to the hole for supporting the flexible wire tie on the base, wherein the base includes a slot extending from an edge of the base to the hole, such that the elongated body can pass through the slot to the hole.

14. The twist tie device of claim 11 wherein the flexible wire tie includes a shape-retaining deformable metal core with a rubber cover or a foam cover.

* * * * *